US006772777B1

(12) United States Patent
Mann

(10) Patent No.: US 6,772,777 B1
(45) Date of Patent: Aug. 10, 2004

(54) HYDRAULIC UMBRELLA

(76) Inventor: Kynan Mann, 794 E. Morada Pl., Altadena, CA (US) 91001

( * ) Notice: Subject to any disclaimer, the term of this patent is extended or adjusted under 35 U.S.C. 154(b) by 0 days.

(21) Appl. No.: 10/145,773

(22) Filed: May 15, 2002

(51) Int. Cl.[7] ..... A45B 25/14

(52) U.S. Cl. ..... 135/20.2; 135/20.3; 135/24; 135/16

(58) Field of Search ..... 135/25.4, 20.2, 135/20.3, 16, 15.1, 22, 24

(56) References Cited

U.S. PATENT DOCUMENTS

| | | | | | |
|---|---|---|---|---|---|
| 3,954,117 | A | * | 5/1976 | Wallace | 135/20.2 |
| 4,543,971 | A | * | 10/1985 | Sirota | 135/16 |
| 4,747,422 | A | * | 5/1988 | Chung | 135/20.2 |
| 4,766,920 | A | * | 8/1988 | Grady, II | 135/20.2 |
| 4,821,756 | A | * | 4/1989 | England | 135/19.5 |
| 5,267,859 | A | * | 12/1993 | Discko, Jr. | 433/89 |
| 5,291,908 | A | | 3/1994 | Grady, II | |
| 5,626,160 | A | | 5/1997 | Ko | |
| 5,690,131 | A | * | 11/1997 | Voigt | 135/19.5 |
| 5,725,004 | A | * | 3/1998 | Moulder | 135/20.2 |
| 6,058,951 | A | | 5/2000 | Wilson | |
| 6,371,140 | B1 | * | 4/2002 | Atanda | 135/20.2 |

FOREIGN PATENT DOCUMENTS

| | | | |
|---|---|---|---|
| EP | 838175 | * | 4/1998 |
| GB | 2091095 | * | 7/1982 |

* cited by examiner

*Primary Examiner*—Winnie Yip

(57) ABSTRACT

A hydraulic umbrella includes a housing assembly that has a perimeter wall for defining an interior space. A main shaft member has a first portion and a second portion. The first portion is positionable within the interior space of the housing. The second portion is positioned external to the housing. A plurality of spoke members is pivotally coupled to a distal end of the second portion. A canopy portion is operationally coupled to the plurality of spokes. The plurality of spoke members provides support for the canopy portion. The plurality of spoke provides a mechanical interface between the main shaft member and the canopy portion. The canopy portion is moveable from the stored position to the deployed position when a distal end of the first portion of the main shaft member extends through the upper aperture.

4 Claims, 4 Drawing Sheets

HYDRAULIC UMBRELLA

BACKGROUND OF THE INVENTION

1. Field of the Invention

The present invention relates to umbrellas and more particularly pertains to a new the hydraulic umbrella for providing a user with an umbrella that is functional as well as unique and stylish.

2. Description of the Prior Art

The use of umbrellas is known in the prior art. U.S. Pat. No. 6,058,951 describes an umbrella capable of being manually or electrically used by a remote control and a pulley turned by a motor. Another type of umbrella is U.S. Pat. No. 5,291,908 describes an umbrella capable of automatically opening and closing using electrical power. U.S. Pat. No. 5,626,160 describes an umbrella that can be opened and closed using a spring assembly.

While these devices fulfill their respective, particular objectives and requirements, the need remains for a device that utilizes hydraulics to open and close the umbrella.

SUMMARY OF THE INVENTION

The present invention meets the needs presented above by incorporating a hydraulic means for opening and closing the canopy.

Another object of the present invention is to provide a new the hydraulic umbrella that would utilize a transparent housing to contain different colors of hydraulic fluid to provide a unique design that would serve as a conversation piece.

Still another object of the present invention is to provide a new the hydraulic umbrella that would make the present invention easy for everyone to operate.

To this end, the present invention generally comprises a housing assembly that has a perimeter wall for defining an interior space. The housing has an upper aperture that extends through a top end of the housing. A main shaft member has a first portion and a second portion. The first portion is positionable within the interior space of the housing. The second portion is positioned external to the housing. A plurality of spoke members is pivotally coupled to a distal end of the second portion. A canopy portion is operationally coupled to the plurality of spokes. The canopy portion has a deployed position and a stored position. The canopy portion has a first surface defining a plane. The stored position is defined by the plane having a substantially parallel relationship with a longitudinal axis of the housing. The deployed position is defined by the plane having a substantially angular relationship with the longitudinal axis of the housing. The canopy portion provides protection from rain when positioned in a deployed position. The plurality of spoke members provides support for the canopy portion. The plurality of spoke provides a mechanical interface between the main shaft member and the canopy portion. The canopy portion is moveable from the stored position to the deployed position when a distal end of the first portion of the main shaft member extends through the upper aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
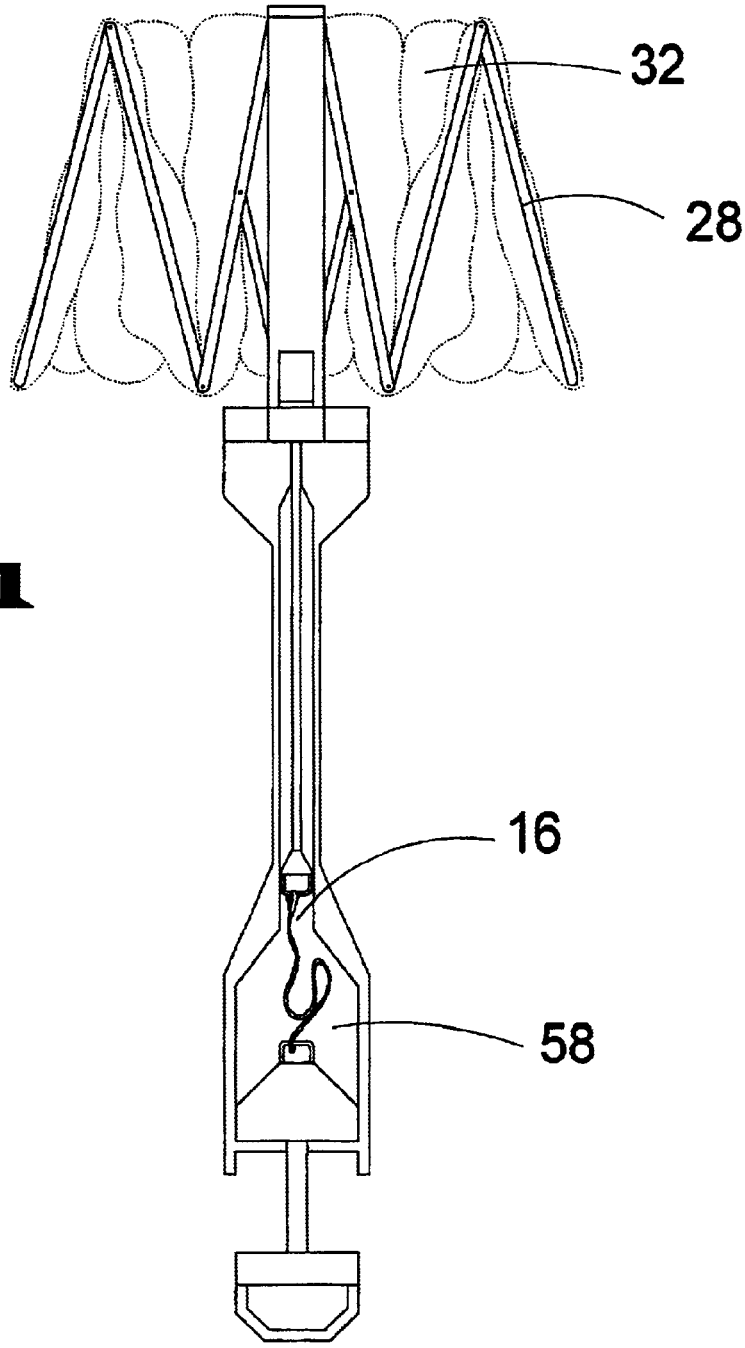
FIG. 1 is a front view of a new the hydraulic umbrella according to the present invention.
Figure 2:
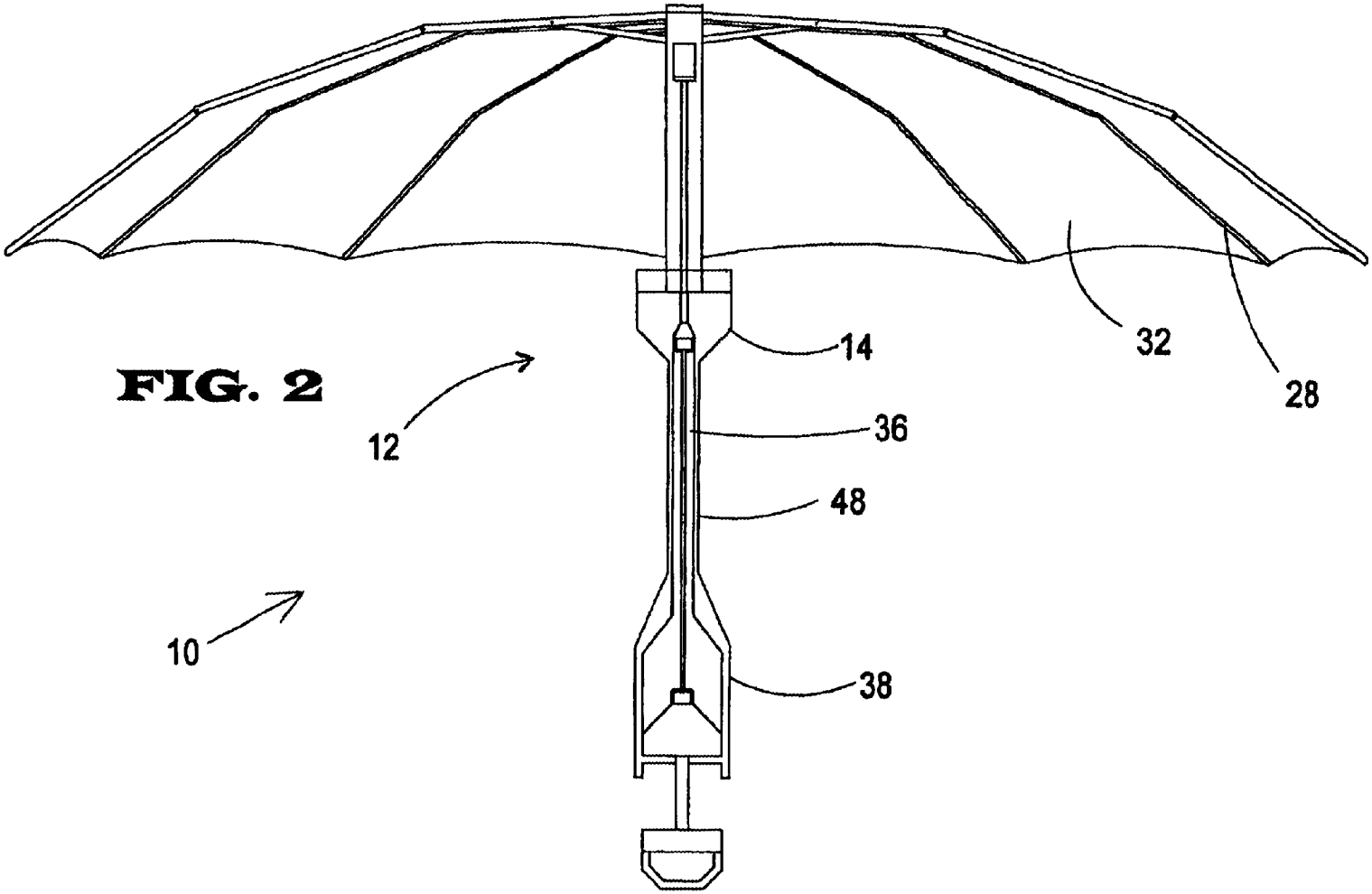
FIG. 2 is a perspective view of the present invention.
Figure 3:
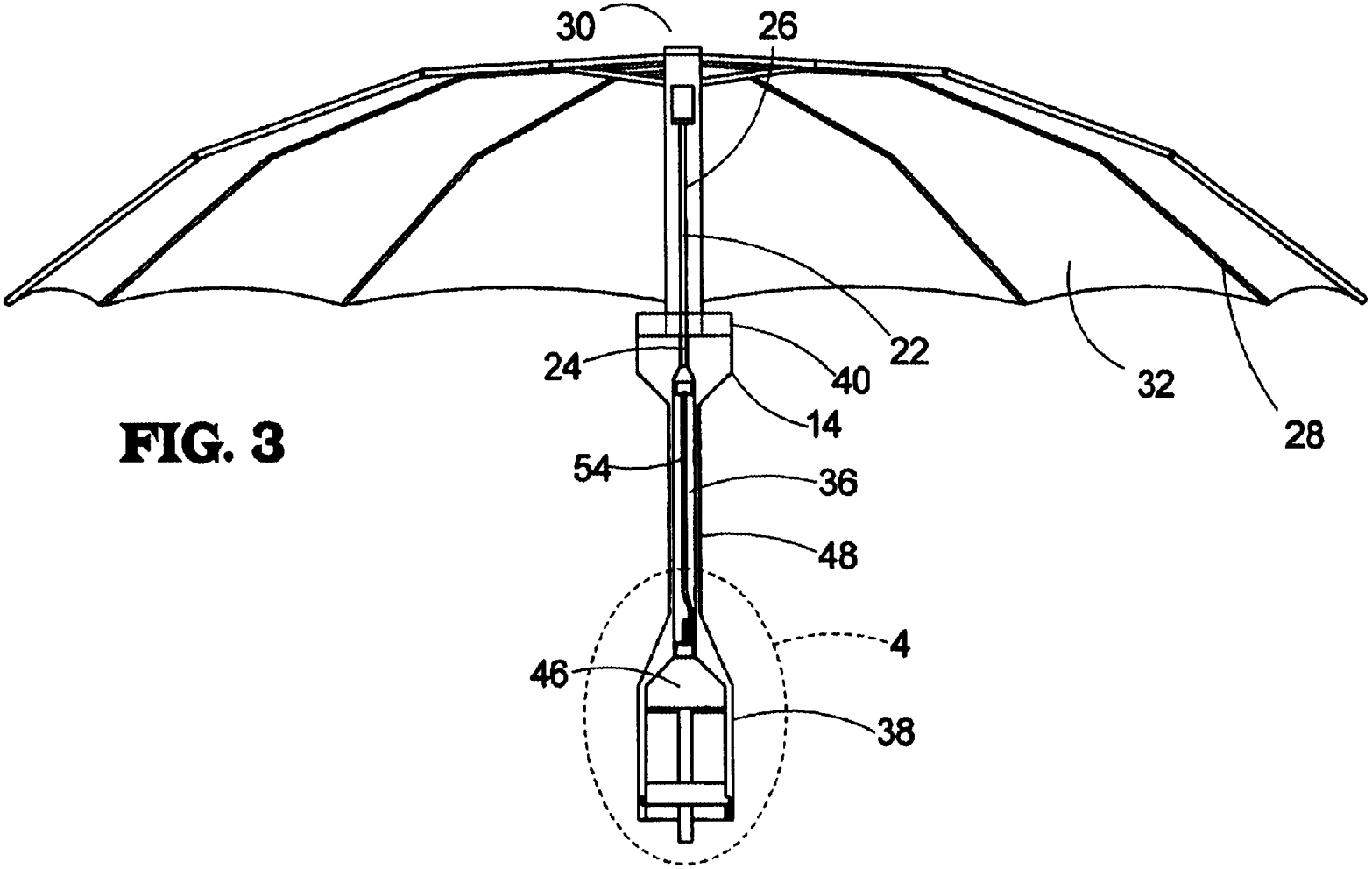
FIG. 3 is a front cross-sectional view of the present invention in a deployed position.
Figure 4:
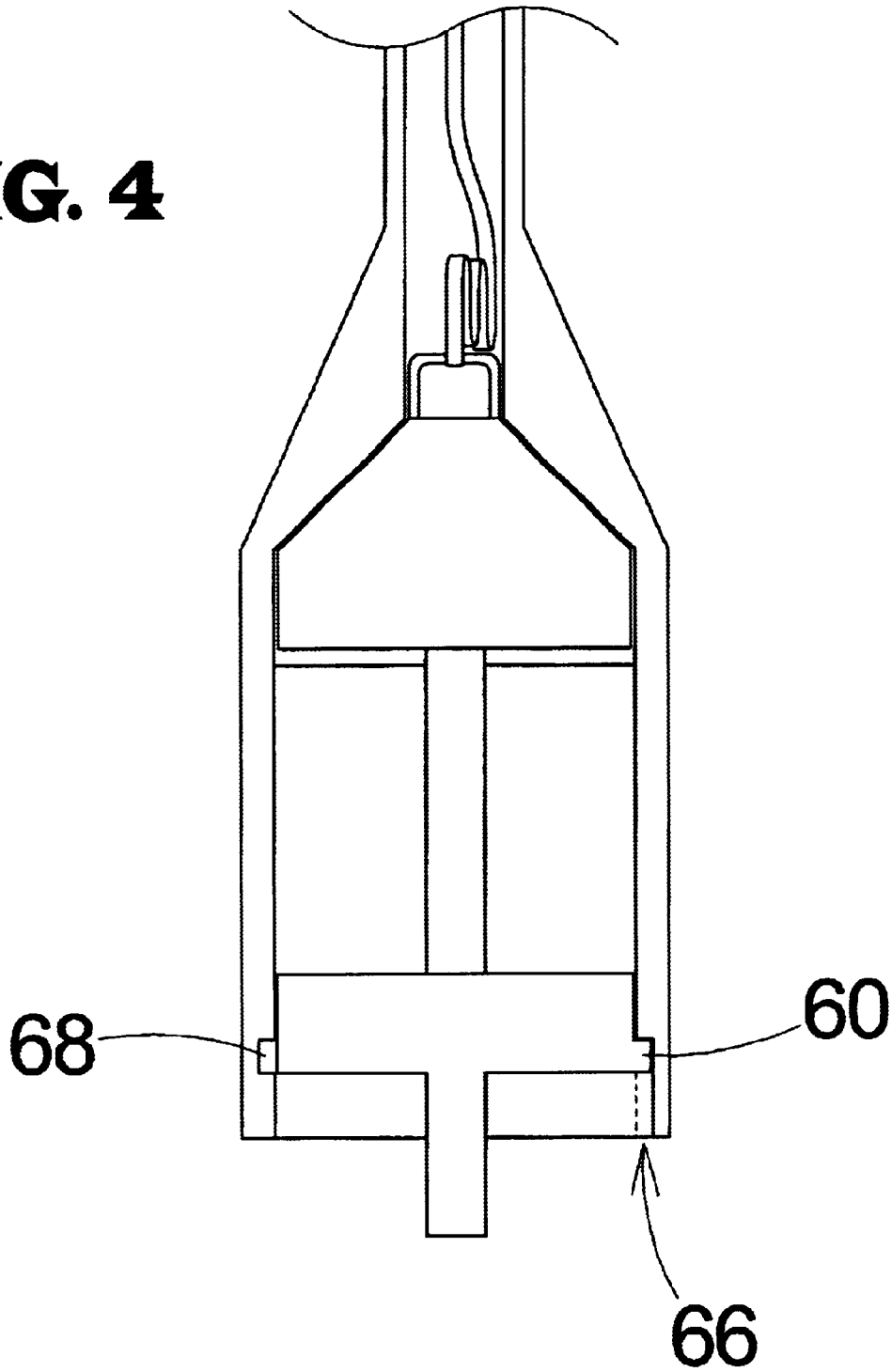
FIG. 4 is a partial cross sectional view of area 4 of FIG. 3 showing the channel, groove and tab member portions of the present invention.

With reference now to the drawings, and in particular to FIGS. 1 through 2 thereof, a new the hydraulic umbrella embodying the principles and concepts of the present invention and generally designated by the reference numeral 10 will be described.

As best illustrated in FIGS. 1 through 2, the hydraulic umbrella 10 generally comprises a housing assembly 12 that has a perimeter wall 14 for defining an interior space 16. The housing has an upper aperture 18 that extends through a top end 20 of the housing 12. A main shaft member 22 has a first portion 24 and a second portion 26. The first portion 24 is positionable within the interior space 16 of the housing 12. The second portion 26 is positioned external to the housing 12. A plurality of spoke members 28 is pivotally coupled to a distal end 30 of the second portion 26. A canopy portion 32 is operationally coupled to the plurality of spoke members 28. The canopy portion 32 has a deployed position and a stored position. The canopy portion 32 has a first surface defining a plane. The stored position is defined by the plane having a substantially parallel relationship with a longitudinal axis of the housing 12. The deployed position is defined by the plane having a substantially angular relationship with the longitudinal axis of the housing 12. The canopy portion 32 provides protection from rain when positioned in a deployed position. The plurality of spoke members 28 provides support for the canopy portion 32. The plurality of spoke provides a mechanical interface between the main shaft member 22 and the canopy portion 32. The canopy portion 32 is moveable from the stored position to the deployed position when a distal end 30 of the first portion 24 of the main shaft member 22 extends through the upper aperture 18. The housing 12 has a cylinder portion 36. The cylinder portion 36 is in environmental communication with the reservoir portion 38. The cylinder portion 36 has a second diameter. The second diameter is substantially less than the first diameter.

The main shaft member 22 has an upper ring member 40 for inhibiting environmental communication between the cylinder portion 36 and an external environment through the aperture 42 when the canopy portion 32 is in a stored position. The main shaft member 22 has a lower ring member 44 for inhibiting environmental communication between the cylinder portion 36 and an external environment through the aperture 42 when the canopy portion 32 is in a deployed position.

A piston member 46 is positioned substantially within the reservoir portion 38. The piston member 46 is for selectively urging the fluid from the reservoir portion 38 into the cylinder portion 36 whereby the main shaft member 22 is extended through the aperture 42 and the canopy portion 32 is deployed.

A handle portion 48 is operationally coupled to the piston member 46. The handle portion 48 is designed to be grasped by a human hand. The handle portion 48 facilitates positioning of the piston member 46 whereby the canopy portion 32 is moved between the stored and deployed positions.

An elongate member 50 has a piston end 52 and a main shaft end 54. The piston end 52 is operationally coupled to the piston member 46. The main shaft end 54 is operationally coupled to a proximal end 56 of the first portion 24 of the main shaft member 22. The elongate member 50 facilitates withdrawing of the main shaft member 22 in conjunction with positioning of handle portion 48 whereby the canopy portion 32 is positioned in the stored position.

The housing 12 is substantially transparent. The fluid 58 is colored such that movement of the fluid 58 between the reservoir portion 38 and the cylinder portion 36 is visible through the housing 12. The housing 12 is substantially transparent and has a tint. The tint minimizes the appearance of fingerprints and dirt on the housing 12 while facilitating visual observation of the fluid 58.

At least one tab member 60 extends outwardly from the handle portion 48. A housing flange portion 62 is positioned adjacent to the lower end 64 of the housing 12. The housing flange portion 62 has an internal surface. The flange portion 62 has an internal diameter slightly larger than a diameter of the handle portion 48. The housing flange 62 has at least one channel 66 positioned on the internal surface. The channel 66 has a longitudinal axis. The channel 66 is positioned such that the longitudinal axis of the channel 66 has a substantially parallel relationship with the longitudinal axis of the housing 12. The housing flange 62 has a groove portion 68. The groove portion 68 is positioned on the internal surface. The groove portion 68 has a longitudinal axis. The groove portion 68 is positioned such that the longitudinal axis of the groove portion 68 has a substantially perpendicular relationship with the longitudinal axis of the channel 66, the channel 66 is connected to the groove 68. The groove 68 and channel 66 is for selectively receiving the tab member 60 when the handle portion 48 abuts the lower end 64 of the housing 12 such that the canopy portion 32 is held in a deployed position.

In use, a user would push the piston upward in the housing to move the hydraulic fluid up and extend the stem out expanding the umbrella. To retract the user would turn the switch to unlock pull the piston down which would tugs on the string dropping hydraulic fluid to the lower stem while retracting the umbrella.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An umbrella system comprising:

a housing assembly, said housing assembly having a perimeter wall defining an interior space, having an upper aperture extending through a top end of said housing;

a main shaft member having a first portion and a second portion, said first portion being positionable within said interior space of said housing, said second portion being positioned external to said housing;

a plurality of spoke members pivotally coupled to a distal end of said second portion;

a canopy portion operationally coupled to said plurality of spokes, said canopy portion having a deployed position and a stored position, said canopy portion having a first surface defining a plane, said stored position being defined by said plane having a substantially parallel relationship with a longitudinal axis of said housing, said deployed position being defined by said plane having a substantially angular relationship with said longitudinal axis of said housing, said canopy portion providing protection from rain when positioned in a deployed position;

said plurality of spoke members providing support for said canopy portion, said plurality of spoke providing a mechanical interface between said main shaft member and said canopy portion;

said canopy portion being moveable from said stored position to said deployed position when a distal end of said first portion of said main shaft member extends through said upper aperture;

said housing having a reservoir portion, said reservoir being adapted for containing a quantity of fluid, said reservoir having a first diameter, said reservoir being positioned adjacent to a lower end of said housing, said housing having a cylinder portion, said cylinder portion being in environmental communication with said reservoir portion, said cylinder portion having a second diameter, said second diameter being substantially less than said first diameter;

said main shaft member having an upper ring member for inhibiting environmental communication between said cylinder portion and an external environment through said aperture when said canopy portion being in a stored position, said main shaft member having an lower ring member for inhibiting environmental communication between said cylinder portion and an external environment through said aperture when said canopy portion being in a deployed position;

a piston member positioned substantially within said reservoir portion, said piston member being for selectively urging said fluid from said reservoir portion into said cylinder portion whereby said main shaft member being extended through said aperture and said canopy portion being deployed;

a handle portion operationally coupled to said piston member, said handle portion being adapted for being grasped by a human hand, said handle portion facilitating positioning of said piston member whereby said canopy portion being moved between said stored and deployed positions;

an elongate member having a piston end and a main shaft end, said piston end being operationally coupled to said piston member, said main shaft end being operationally coupled to a proximal end of said first portion of said main shaft member, said elongate member facilitating withdraw of said main shaft member in conjunction with positioning of handle portion whereby said canopy portion being positioned in said stored positions;

at least one tab member extending outwardly from said handle portion; and a housing flange portion positioned adjacent to said lower end of said housing, said housing flange portion having an internal surface, said flange portion having an internal diameter slightly larger than a diameter of said handle portion, said housing flange having at least one channel positioned on said internal surface, said channel having a longitudinal axis, said channel being positioned such that said longitudinal axis of c said channel having a substantially parallel relationship with said longitudinal axis of said housing, said housing flange having a groove portion, said groove portion being positioned on said internal surface, said groove portion having a longitudinal axis, said groove portion being positioned such that said longitudinal axis of said groove portion having a substantially perpendicular relationship with said longitudinal axis of said channel, said channel being connected to said groove; said groove and channel being for selectively receiving said tab member when said handle portion abuts said lower end of said housing such that said canopy portion being held in a deployed position.

2. The assembly of claim 1, wherein said housing being substantially transparent, said fluid being colored such that movement of said fluid between said reservoir portion and said cylinder portion being visible through said housing.

3. The assembly of claim 2, wherein said housing assembly being substantially transparent and having a tint, said tint minimizing an appearance of fingerprints and dirt on said housing while facilitating visual observation of said fluid.

4. The assembly of claim 1, wherein said housing assembly being substantially transparent and having a tint, said tint minimizing an appearance of fingerprints and dirt on said housing while facilitating visual observation of said fluid.

* * * * *